US006684570B1

(12) United States Patent
Robledo

(10) Patent No.: US 6,684,570 B1
(45) Date of Patent: Feb. 3, 2004

(54) DOOR LOCK SYSTEM

(76) Inventor: Angel S. Robledo, 530 SW. 4 Ave., Miami, FL (US) 33130

( * ) Notice: Subject to any disclaimer, the term of this patent is extended or adjusted under 35 U.S.C. 154(b) by 0 days.

(21) Appl. No.: 10/303,176

(22) Filed: Nov. 25, 2002

(51) Int. Cl.[7] ..... E06B 65/06; E06B 1/04; E05C 1/04

(52) U.S. Cl. ..... 49/394; 49/504; 292/145; 292/147

(58) Field of Search ..... 49/394, 503, 504; 292/63, 170, 175, 145, 147, 146, 150

(56) References Cited

U.S. PATENT DOCUMENTS 1,411,129 A * 3/1922 Strosnider ..... 292/196
2,717,064 A * 9/1955 Hock ..... 49/394
3,102,307 A * 9/1963 Johnson et al. ..... 49/394
3,298,134 A * 1/1967 Overby ..... 49/394
3,405,960 A * 10/1968 Wargo ..... 292/145
5,080,354 A * 1/1992 McDougall ..... 292/145
5,427,422 A * 6/1995 Madlener et al. ..... 292/145
5,603,184 A * 2/1997 Campbell et al. ..... 49/394
5,746,455 A * 5/1998 Takimoto ..... 292/145

* cited by examiner

*Primary Examiner*—Hugh B. Thompson, II
(74) *Attorney, Agent, or Firm*—J. Sanchelima; A. Bordas

(57) ABSTRACT

A door lock system for use in commercial restroom establishments. The door lock system is installed on a doorjamb having a swing door. The door lock system primarily comprises a latch assembly, a faceplate assembly, and a stop-plate assembly. The latch assembly comprises a support bracket having a channel, which is mounted on the interior face of the doorjamb. A slide bolt slides within the channel by a handle and through the faceplate assembly, when operated by a user. To lock the swing door, it is closed against the stop-plate assembly, which is mounted onto the exterior face of the doorjamb, and the slide bolt is positioned snugly over the interior face of the swing door, thus locking the swing door in place.

2 Claims, 4 Drawing Sheets

DOOR LOCK SYSTEM

BACKGROUND OF THE INVENTION

1. Field of the Invention

The present invention relates to door locks, and more particularly, to door lock systems for commercial restroom establishments.

2. Description of the Related Art

Many designs for door locking systems have been designed in the past. None of them, however, provide a door lock system that will lock even when a swing type door is not parallel to a respective doorjamb.

Applicant believes that the closest reference corresponds to U.S. Pat. No. 5,603,184 issued to Campbell et al. for a sliding door latch having sanitary hook. However, it differs from the present invention because Campbell et al. teaches a door latch member (16) slidably supported on a door (14) between a latched position in which the latch member (16) engages a door frame (12) to prevent the free swinging edge of the door (14) from moving with respect to the frame (12), and an unlatched position in which the latch member (16) is spaced apart from the frame (12) to allow the free swinging edge of the door (14) to move relative to the frame (12). The latch member (16) includes a hook (18) having a "U" shape extending outwardly therefrom in a horizontal plane perpendicular to the door (14), the hook (18) presenting a concave pocket facing the outer swinging edge of the door (14) for receiving a human forearm to move the latch member (16) from the latched position to the unlatched position.

Other similar art teaches a male latch system on the interior side of the swinging door that must align with, and engage, a female lock bar on the interior side of the fixed door. When the alignment is not proper, the lock fails to work properly.

The instant invention however, allows the locking of doors even when a swing type door is not parallel to a respective doorjamb.

Other patents describing the closest subject matter provide for a number of more or less complicated features that fail to solve the problem in an efficient and economical way. None of these patents suggest the novel features of the present invention.

SUMMARY OF THE INVENTION

A door lock system for commercial restrooms comprising, a door frame assembly having first and second doorjambs defining a door space for receiving a door. The first doorjamb has first and second faces and the second doorjamb has third and fourth faces. The door has an edge and fifth and sixth faces, and is hingedly mounted from the fifth face to the first face of the first doorjamb.

A latch assembly comprises a support bracket mounted onto the third face of the second doorjamb. The support bracket has first and second ends, and a channel with third and fourth ends. The third and fourth ends are in between the first and second ends. The channel housing has a slidebolt with fifth and sixth ends and a handle at the fifth end, which protrudes from the channel to enable a user to place the slidebolt into a locked position from an unlocked position and vice-a-versa, wherein the locked position occurs when the handle is biased against the third end when the door is closed and enabling the slidebolt to extend beyond the edge and to a predetermined distance over the fifth face and the unlocked position occurs when the handle is biased against the fourth end.

A faceplate assembly perpendicularly disposed to the support bracket partially covers the edge. The faceplate assembly has a through hole of cooperative dimensions to allow the slidebolt to snugly slide therethrough.

The instant invention also has a stop plate assembly mounted onto the fourth face, which is parallel to the support bracket and perpendicular to the faceplate assembly. The stop plate assembly is approximately flush with the fourth wall and extends beyond the edge to prevent the door from swinging beyond the fourth face when in the closed position.

The door lock system is placed into the locked position when the edge of the door is between 0 to 15 degrees with relation to the second doorjamb.

It is therefore one of the main objects of the present invention to provide a door lock system that will lock even when the door it is mounted upon is not parallel to a respective doorjamb.

It is yet another object of this invention to provide such a device that is inexpensive to manufacture and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE PREFERRED EMBODIMENT

Figure 1:
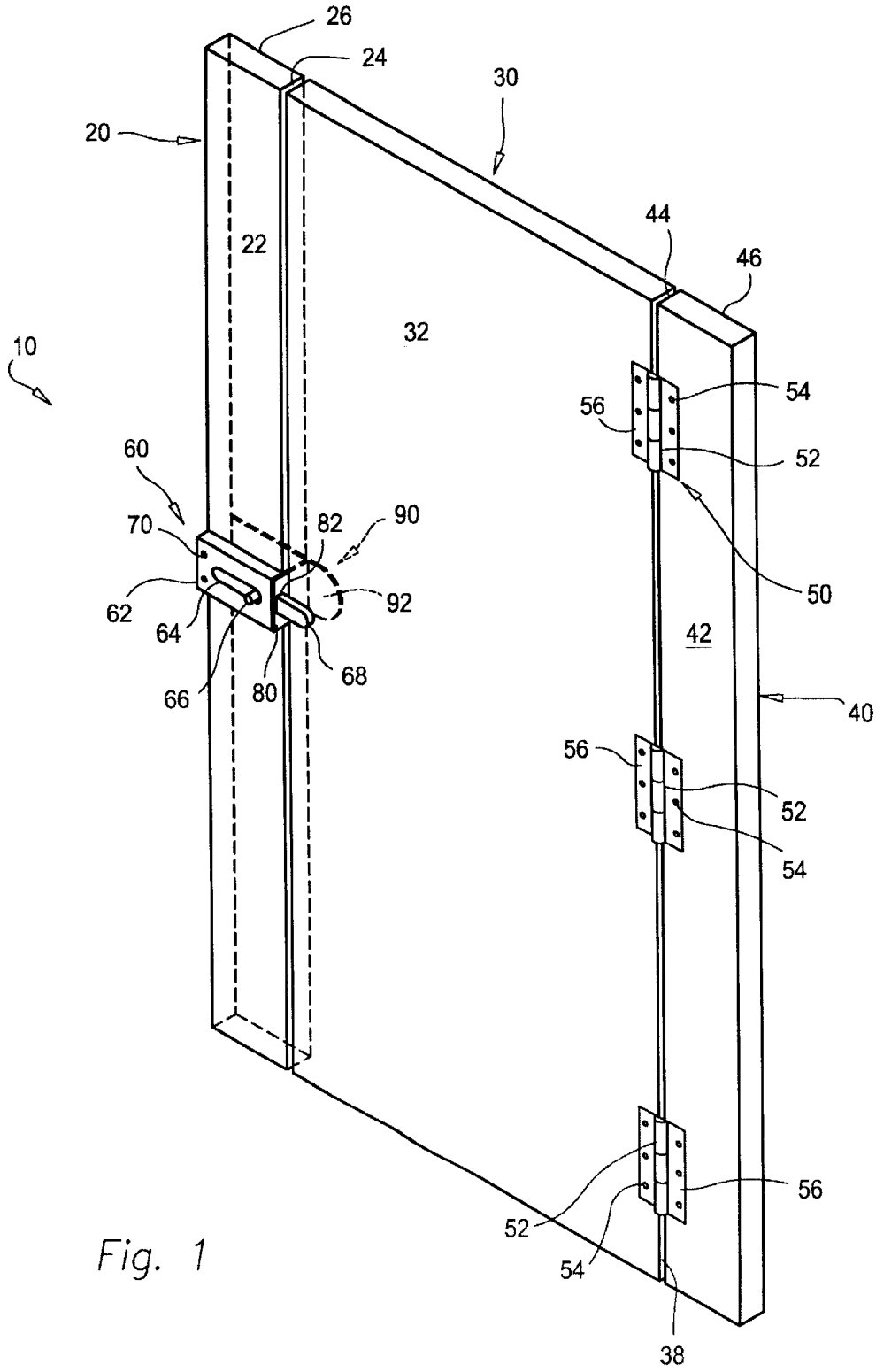
FIG. 1 represents an isometric view of the instant invention seen from the interior side of the door assembly.

Referring now to the drawings, where the present invention is generally referred to with numeral 10, it can be observed that it basically includes latch assembly 60, faceplate assembly 80, and stop-plate assembly 90.

As seen in FIG. 1, instant invention 10 comprises doorjamb 20. Doorjamb 20 includes interior face 22 parallel and equally spaced apart to exterior face 26 by edge 24. Mounted onto doorjamb 20 is the door lock system defined by latch assembly 60, faceplate assembly 80, and stop-plate assembly 90.

Opposite doorjamb 20 is doorjamb 40. Similar to doorjamb 20, doorjamb 40 includes interior face 42 parallel and equally spaced apart to exterior face 46 by edge 44. Secured onto interior face 42 at predetermined distances from each other, are hinge assemblies 50. Hinge assemblies 50 comprise hinge 52 connecting hinge plates 56. Hinge plates 56 have a plurality of through holes for screws 54, which secure hinge assembly 50 onto interior face 42 of doorjamb 40, and interior face 32 of swing door 30.

Figure 2:
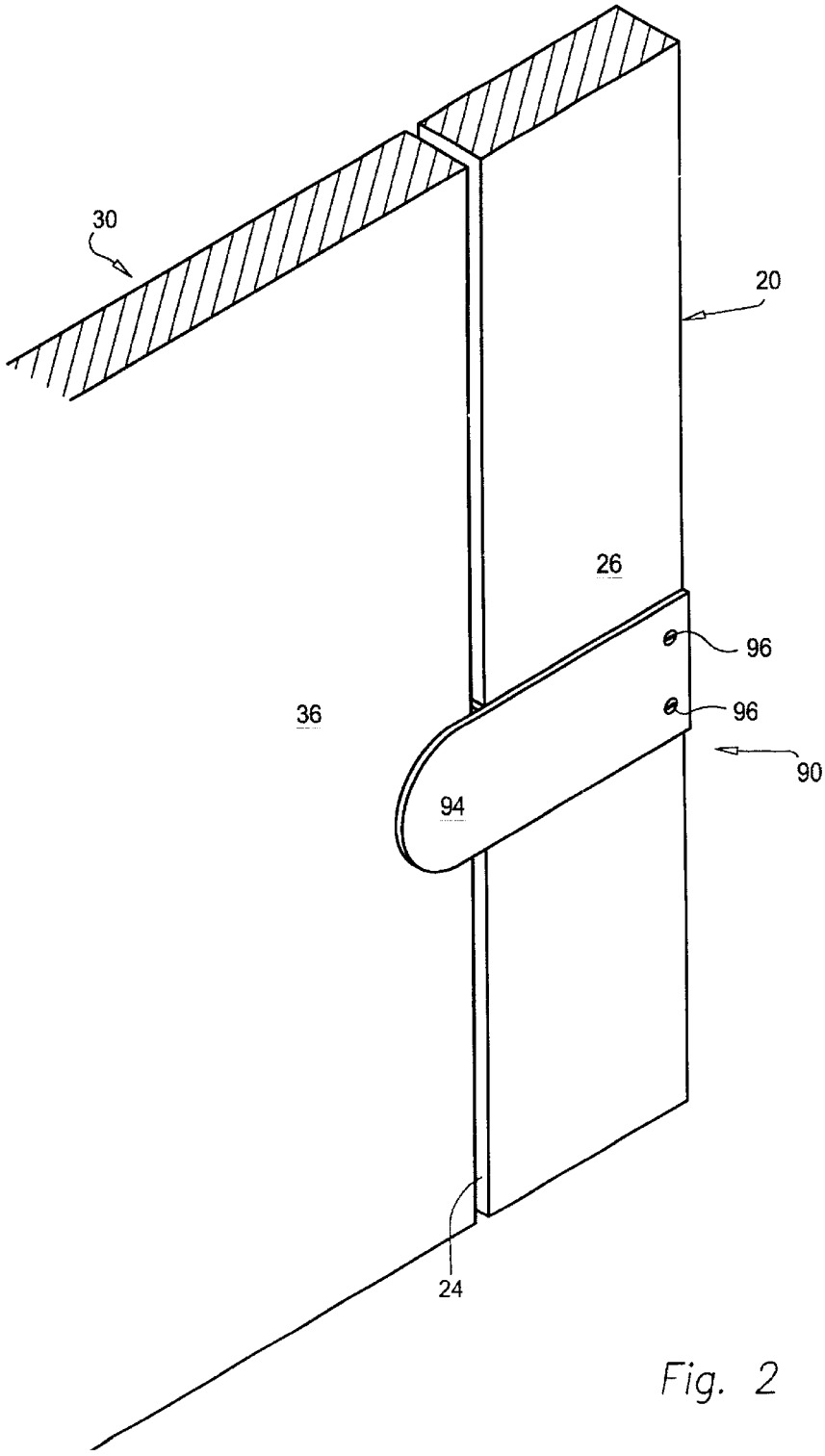
FIG. 2 is a perspective view of the instant invention seen from the exterior side of the door assembly.

Swing door 30 comprises interior face 32 parallel and equally spaced apart to exterior face 36 by edges 34 and 38, seen in FIG. 2.

As seen in the illustrated embodiment, the door lock system defined by latch assembly 60, faceplate assembly 80, and stop-plate assembly 90 is in the locked position with swing door 30 in the closed position. To achieve the illustrated positions, swing door 30 is closed until exterior face 36, better seen in FIG. 2, abuts interior face 92 of stop-plate assembly 90. Then an engagement tip, defined as slide bolt 68, is snugly positioned over interior face 32 of swing door 30 with handle 66, thus locking swing door 30 in place.

Figure 3:
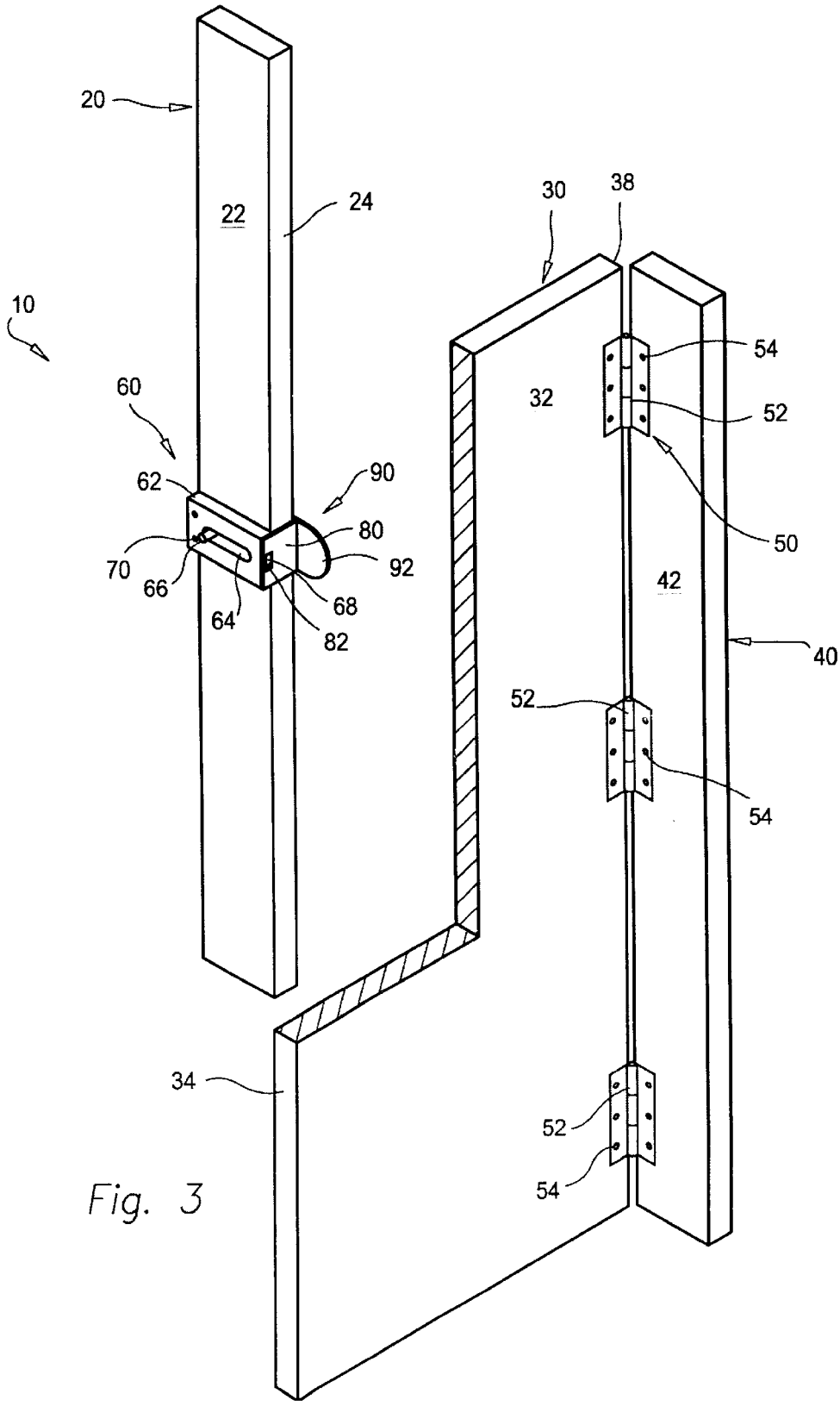
FIG. 3 is a perspective view of the instant invention seen from the interior side of the door assembly with a cutout view of the swing door in the open position.

In the preferred embodiment, edges 24 and 34, best seen in FIG. 3, are parallel with one another, so that swing door 30 may easily open and close. Edges 24 and 34, parallel to one another, define a 0 degree angle between swing door 30 and doorjamb 20. However, in many cases, particularly in commercial restroom establishments, hinge assemblies 50 fail, causing edges 24 and 34 to not be parallel to one another when swing door 30 hangs. Edges 24 and 34, when not parallel to one another, define an angle measured in degrees, between swing door 30 and doorjamb 20. Even when edges 24 and 34 are not parallel to one another, up to a 15 degree angle between swing door 30 and doorjamb 20, the instant invention works to lock swing door 30 in the closed position, so long as exterior face 36 abuts the interior face of stop-plate assembly 90, as seen in FIG. 2.

As best seen in FIG. 2, in the closed position, exterior face 36 of swing door 30 abuts the interior face of stop-plate assembly 90. In the preferred embodiment, stop-plate assembly 90 should be approximately flush with exterior face 36 of swing door 30. Stop-plate assembly 90 also comprises a plurality of through holes to allow for screws 96 to secure onto exterior face 26 of doorjamb 20.

As seen in FIG. 3, the door lock system defined by latch assembly 60, faceplate assembly 80, and stop-plate assembly 90 is in the unlocked position with swing door 30 in the open position. To achieve the illustrated positions, the engagement tip, defined as slide bolt 68 is removed from over interior face 32 of swing door 30 with handle 66, thus unlocking swing door 30. Swing door 30 is then opened as seen in the illustrated embodiment.

Figure 4A:
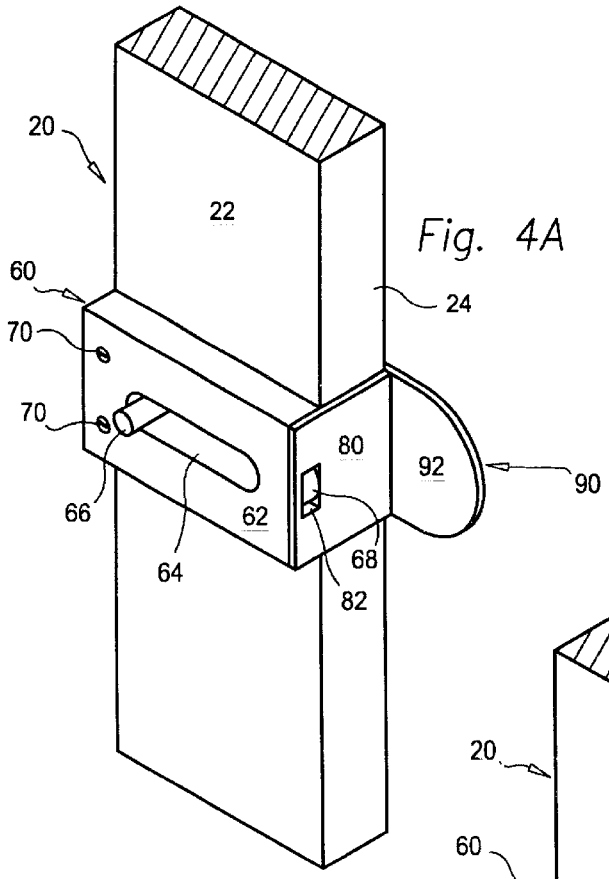
FIG. 4A is an enlarged perspective view of the door lock system in the unlocked position.
Figure 4B:
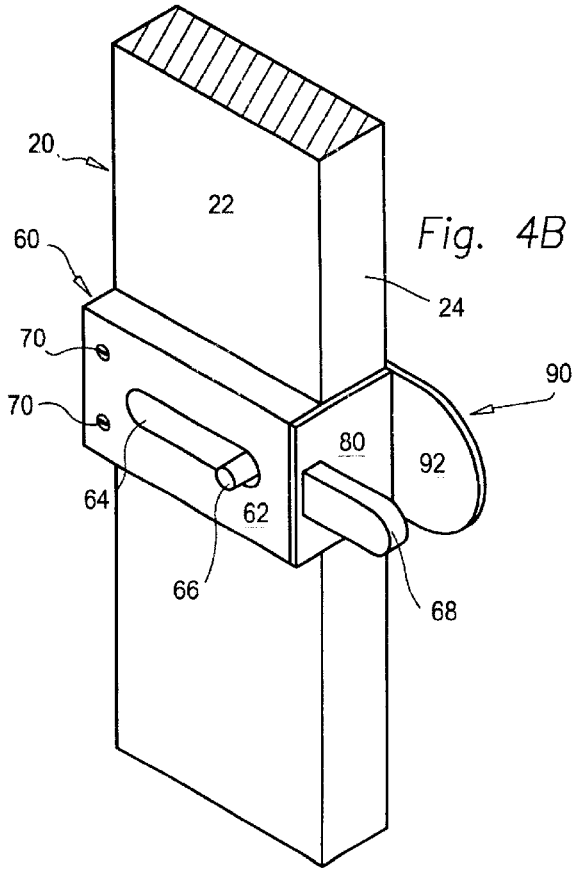
FIG. 4B is an enlarged perspective view of the door lock system in the locked position.

As seen in FIG. 4A, the door lock system defined by latch assembly 60, faceplate assembly 80, and stop-plate assembly 90 is in the unlocked position. Latch assembly 60 comprises support bracket 62 having channel 64. Protruding from channel 64 is handle 66 of slide bolt 68. Handle 66 extends from slide bolt 68 and is of cooperative characteristics to slide in a generally horizontal manner within channel 64. Support bracket 62 is mounted onto interior face 22 of doorjamb 20 with screws 70 or other similar means of attachment. Perpendicularly extending from support bracket 62 and partially covering edge 24, is faceplate assembly 80. Faceplate assembly 80 has hole 82, and is positioned to be aligned with slide bolt 68 so that it may snugly slide out therefrom to the locked position illustrated in FIG. 4B. Perpendicularly extending from faceplate assembly 80 and approximately flush with exterior face 26, seen in FIG. 2, is interior face 92.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A door lock system for commercial restrooms comprising:

a) a door frame assembly having first and second doorjambs defining a door space for receiving a door, said first doorjamb having first and second faces and said second doorjamb having third and fourth faces, said door having an edge and fifth and sixth faces and is hingedly mounted from said fifth face to said first face of said first doorjamb;

b) a latch assembly comprising a support bracket mounted onto said third face of said second doorjamb, said support bracket having first and second ends and a channel with third and fourth ends, said third and fourth ends in between said first and second ends, said channel housing a slidebolt having fifth and sixth ends, a handle at said fifth end protrudes from said channel to enable a user to place said slidebolt into a locked position from an unlocked position and vice-a-virsa, wherein said locked position occurs when said handle is biased against said third end when said door is closed and enabling said slidebolt to extend beyond said edge and to a predetermined distance over said fifth face and said unlocked position occurs when said handle is biased against said fourth end;

c) a faceplate assembly mounted to the second doorjamb, said faceplate assembly having a through hole of cooperative dimensions to allow said slidebolt to snugly slide therethrough; and d) a stop plate assembly mounted onto said fourth face, parallel to said support bracket and perpendicular to said faceplate assembly, said stop plate assembly approximately flush with said fourth wall and extending beyond said edge to prevent said door from swinging beyond said fourth face when in said closed position.

2. The door lock system for commercial restrooms set forth in claim 1, wherein said door lock system is placed in said locked position when said edge of said door is between 0 to 15 degrees with relation to said second doorjamb.

* * * * *